US008286673B1

(12) United States Patent
Recker et al.

(10) Patent No.: US 8,286,673 B1
(45) Date of Patent: Oct. 16, 2012

(54) OPACITY FILTERING SYSTEM

(75) Inventors: Mark L. Recker, Leipsic, OH (US); Robert Benjamin Hill, Findlay, OH (US)

(73) Assignee: Marathon Petroleum Company LLC, Findlay, OH (US)

( * ) Notice: Subject to any disclaimer, the term of this patent is extended or adjusted under 35 U.S.C. 154(b) by 678 days.

(21) Appl. No.: 12/459,697

(22) Filed: Jul. 6, 2009

(51) Int. Cl.
*B65B 31/00* (2006.01)

(52) U.S. Cl. ..... 141/59; 141/4; 141/5; 141/6; 141/7; 141/8

(58) Field of Classification Search ..... 141/4–8, 141/59
See application file for complete search history.

(56) References Cited

U.S. PATENT DOCUMENTS

| | | | | |
|---|---|---|---|---|
| 4,844,133 | A * | 7/1989 | von Meyerinck et al. | 141/387 |
| 5,507,326 | A * | 4/1996 | Cadman et al. | 141/198 |
| 6,099,616 | A * | 8/2000 | Jenne et al. | 95/1 |
| 6,528,047 | B2 * | 3/2003 | Arif et al. | 424/76.1 |
| 6,589,323 | B1 * | 7/2003 | Korin | 96/223 |
| 6,772,741 | B1 * | 8/2004 | Pittel et al. | 123/519 |
| 6,835,223 | B2 * | 12/2004 | Walker et al. | 55/385.1 |

* cited by examiner

*Primary Examiner* — Timothy L Maust
(74) *Attorney, Agent, or Firm* — Emch, Schaffer, Schaub & Porcello Co., L.P.A.

(57) ABSTRACT

This system provides for odor control by using a rack opacity filtering system (ROFS). This is a system that collects opacity at the point of origin and transfers it to the filter unit. The filter unit then removes the opacity from the air and the clean air is then vented to the atmosphere. The opacity is a result of loading additized asphalt product at elevated temperatures and controlling how much opacity is allowed to be released. ROFS provides a means to virtually eliminate opacity.

11 Claims, 5 Drawing Sheets

OPACITY FILTERING SYSTEM

TECHNICAL FIELD OF THE INVENTION

This invention relates to recovering vapors during the dispensing of fluids from a storage tank to a receiving tank. More specifically, the invention relates to the recovery of volatiles during transfer from one tank to another tank in loading lanes at asphalt terminals.

BACKGROUND OF THE INVENTION

Tanks used for storing or transporting flammable fluids such as gasoline, diesel fuel and other petroleum products are often equipped with protection devices. When the fluids are being transferred from the storage tanks to recipient tanks, these devices detect when the recipient tanks are full and automatically disable the transfer process. Tanks can be mounted on tanker trucks or located underground at service stations. Tanker trucks are typically filled with the fluids using pumping equipment at the loading racks of marketing terminals, and underground storage tanks are typically gravity-filled from the trucks.

Asphalts also are transferred in a similar fashion. Asphalts are well known and widely used in a variety of products. While asphalts are primarily composed of high molecular weight hydrocarbons, they invariably contain minor amounts of low molecular weight hydrocarbons exhibiting substantial volatility. As such, the manufacture, storage and transportation of asphalt materials present opportunities for escape of the volatile, organic components (VOCs) into the atmosphere.

Odor control and fume recovery would be highly desirable. A wide variety of systems exists for treating asphalt vapors. These systems collect, adsorb, absorb, oxidize, react, suppress or perfume the asphalt vapors. Additives such as citrus terpenes and cherry odor additives merely mask the problem.

Recent developments in odor control and drop tube assemblies are disclosed in U.S. Pat. Nos. 6,935,387 and 7,225,840, the disclosures of which are herein incorporated by reference.

The apparatus of this invention represents a further improvement in rack opacity filtering systems.

BRIEF SUMMARY OF THE INVENTION

Our novel invention provides for odor control by using a rack opacity filtering system (ROFS). This is a system that collects opacity at the point of origin and transfers it to the filter unit. The filter unit then removes the opacity from the air and the clean air is then vented to the atmosphere. The opacity is a result of loading additized asphalt product at elevated temperatures and controlling how much opacity is allowed to be released. ROFS provides a means to virtually eliminate opacity.

The apparatus of this invention for recovering vapors during the dispensing of liquid from a dispensing tank to a receiving tank comprises: a loading arm dispenses liquid in to the receiving tank from the dispensing tank; a vapor recovery hood around the loading arm covering the receiving tank and a vapor recovery conduit attached to the hood for recovering vapors from the receiving tank. The hood further comprises a first orifice wherein the loading arm passes through the orifice to the receiving tank.

In one embodiment, the apparatus also includes a vapor recovery system including one or two initial stages of filtering, and a variable speed blower-pulling vacuum on the vapor recovery system. In another embodiment, the apparatus may include a carbon filter.

Limits have been set on how much opacity can be released to the atmosphere during a venting process. Our system collects the vapors being released at the dome opening on the truck, transfers them to a filter unit and exhausts them in a safe and clean manner.

Other objects and advantages of the present invention will become apparent to those skilled in the art upon a review of the following detailed description of the preferred embodiments and the accompanying drawings.

DETAILED DESCRIPTION OF THE INVENTION

The invention is a positive suction system where the vapors released from the tanker truck are captured provides a means to expand the application of the system to include, hazardous vapor removal, odor control, along with the opacity elimination.

By having the vapor hose attached to the hood on the load arm ensures that the hood/hose is in place to capture the vapors during every load. Removing the vapors from the loading rack and venting them at a remote location has improved the air quality at the loading rack.

Figure 1:
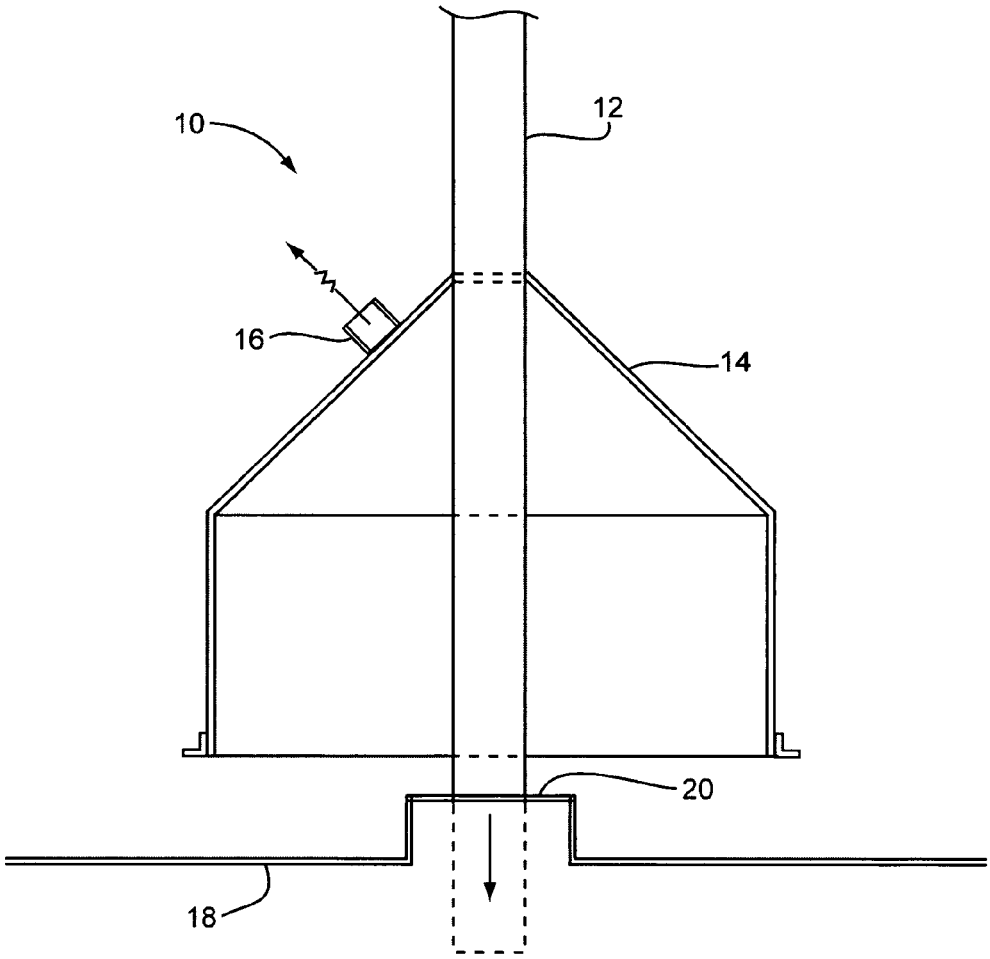
FIG. 1 is a side view of a hood and loading arm used with the odor control assembly of this invention. The assembly is in place over the opening of a receiving tank.

FIG. 1 is a side view of a hood and loading arm used with the odor control assembly of this invention. The assembly is in place over the opening of a receiving tank. FIG. 1 shows assembly 10, which includes hood 14 and duct connector 16. Assembly 10 is positioned over receiving tank 18 and opening 20. Typically receiving tank 18 rests on a truck. A vapor recovery duct connects to duct connector 16.

Figure 2:
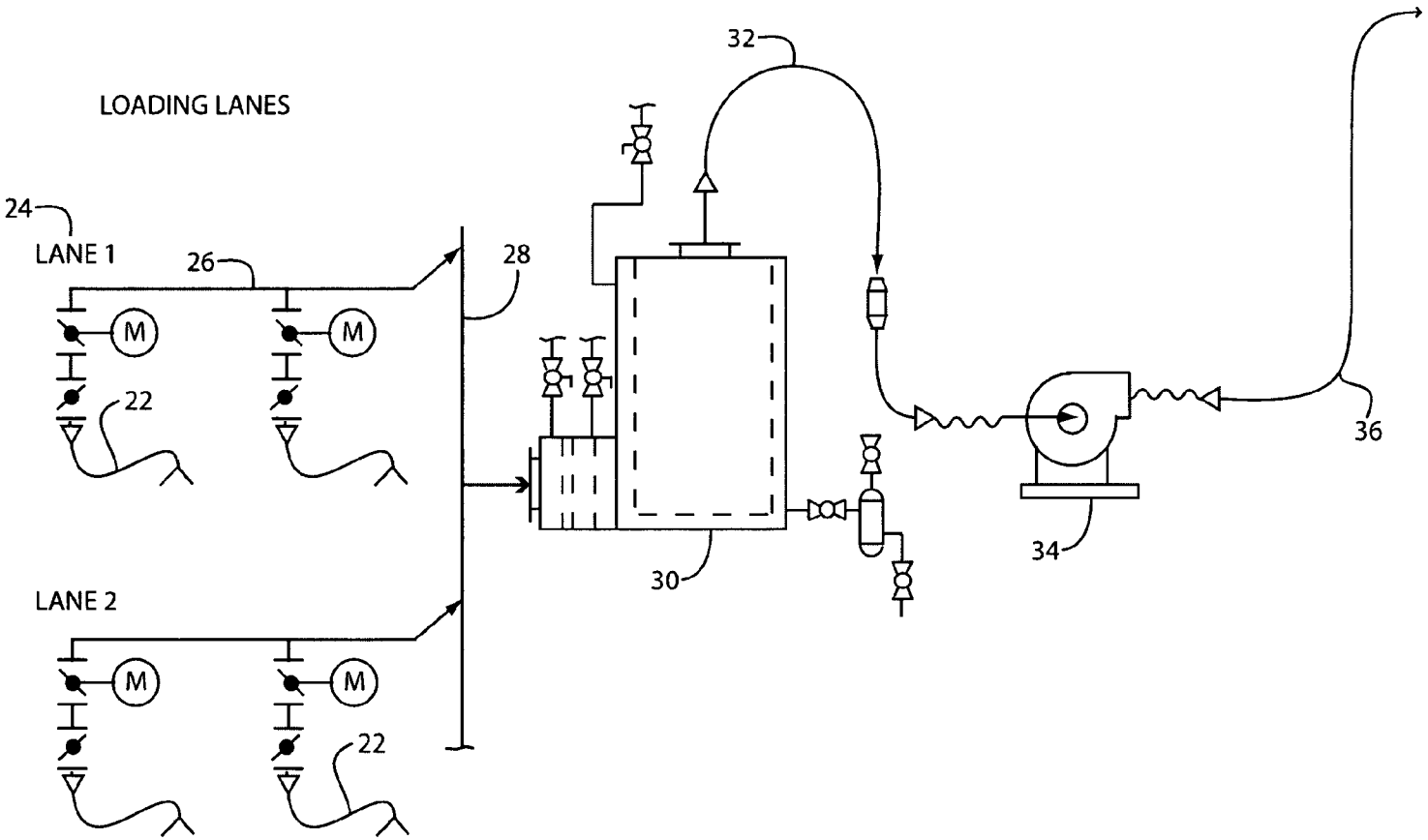
FIG. 2 is a schematic view of the loading lanes and rack opacity filtering system (ROFS) of this invention.

FIG. 2 is a schematic view of the loading lanes and rack opacity filtering system (ROFS) of this invention. Vapor recovery duct 22 attaches to duct connector 16 on hood 14 and transports vapor away from loading lanes 24 via conduits 26. Conduit 28 connects conduits 26 with opacity filter 30. Conduit 32 connects filter 30 to blower 34. Ductwork 36 connects blower 34 to second stage opacity filter 40 (shown in FIG. 3). As can be appreciated a multiplicity of loading lanes 24 may be vented with a properly sized opacity filter 30 and blowers 34. A carbon canisters not shown also may be used.

Figure 3:
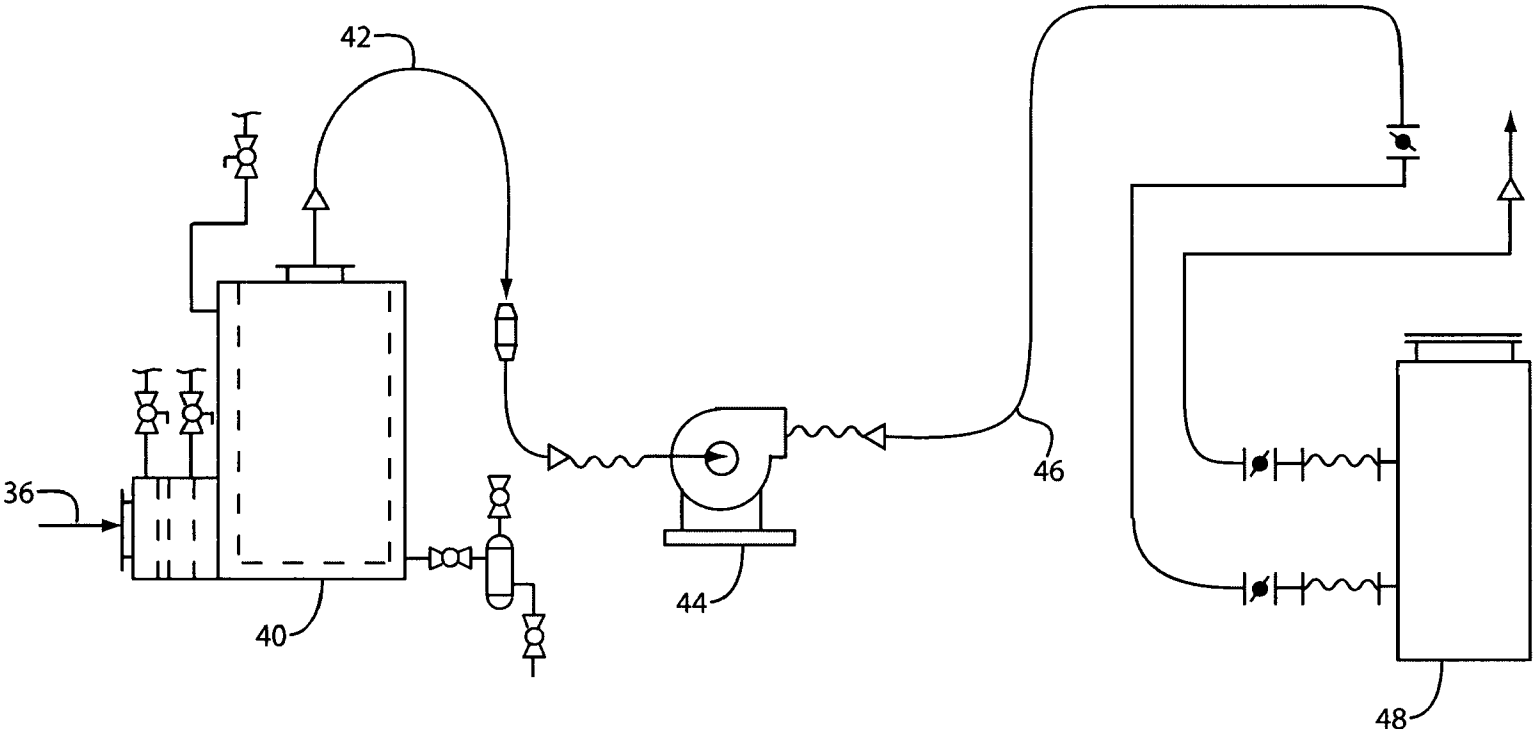
FIG. 3 is a schematic view of the second stage of the ROFS of the invention.

FIG. 3 is a schematic view of the second stage of the ROFS of this invention. Ductwork 36 from FIG. 2 connects blower 34 to second stage opacity filter 40. Fumes from loading lanes 34 are processed a second time in filter 40. Ductwork 42 connects blower 44 to filter 40. Ductwork 42 connects blower 44 to filter 40. Ductwork 46 exhaust the clean air into the atmosphere. FIG. 3 shows the clean air passing through carbon canister 48 before being vented into the atmosphere.

Filter 30 is a coarse mesh filter, which removes large particles and condensed droplets. Filter 40 is a coalescing filter.

The preceding reduces odors from storage tanks and loading facilities at asphalt terminals.

A dual system was installed for the tanks and trucks. The combined system was operated continuously at a low flow rate to handle stray vapors from the tanks when they are not being filled. The system would be turned to a high flow rate based on vacuum transmitter whenever the tanks are receiving product. The collection ductwork will be an open system, allowing the tank to breathe regardless of the odor control device.

The dual system is used for the loading rack. The loading rack system is operated on an as-needed basis. The blowers on this system are run at a speed proportional to the number of loading arms being used. The vapor collection system at the truck will consist of the hood around the loading arm with the hood over the truck opening and flexible ductwork to the main collection ductwork. Actuated valves will be automatically opened when loading operations starts and automatically shut when the loading operation is complete.

Both of the systems use two initial stages of filtering to knock out the heavy vapors increasing the life of the carbon. These filters consist of a coarse mesh filter and a coalescing type filter. The ductwork drains may be heat traced and insulated to keep them from freezing.

In the loading rack vapor collections, each loading arm will have a fume collection hood. This could be as many as 16 loading arms or loading lanes. Each collection hood will consist of a concentric pipe around the loading arm with a cover over the truck opening and flexible ductwork to the main collection ductwork. The opening will allow visual inspection of the loading process and allow dilution air into the vapor piping. Actuated valves will start and stop vapor collection flow based on the arms being in use. The vacuum in the main collection ductwork will be maintained at the proper level by the use of variable speed drives on the blowers to assure the desired airflow through all open arms. Insulated and heat traced drain legs are provided throughout the fume system to collect condensed water and asphalt vapors. The heat trace is primarily for freeze protection.

In the tank vapor collection, the existing tank vent discharge, at the lower part of the vent pipe, has a drain leg and tee to the fume collection system. The drain leg is open at the bottom, which allows dilution air to enter and mix with the fume stream. This will cause condensation and lower the load on the abatement device. A continuous low-level airflow will be kept on the system to collect vapors that the tank may give off when the tank is not being filled. The system will be automatically switched into high flow based on vacuum transmission, when the tank is being filled. Insulated and heat traced drain legs are provided throughout the fume system to collect condensed water and asphalt vapors. The heat trace is primarily for freeze protection.

In the three (3) Stage Filtering System (Loading Lanes & Tank Vents), fume enters a stage 1 coarse mesh filter. Stage 2 is a coalescing filter which removes the large particles and condensed particles down to the plus-micron sizes. The remaining fume then enters the stage 3 carbon filter where sub-micron particles and odors are removed. The pressure differential will be monitored across all three filters, and will be used to determine when the filters need to be changed. The current method of replacing the carbon is to change out the complete carbon vessel and replace it with a new one. In another embodiment, the spent carbon is tested before removal to determine if it can be reactivated. Spent carbon is removed by a pneumatic conveying system. Carbon is delivered by truck in large super sacks and is pneumatically conveyed into the carbon chamber.

The fume collection fans are provided with a variable frequency drives, which are automatically controlled by the loading rack. Detonation arrestors and fire stop valves also have been included. A detonation arrestor also has been provided between the pre-filter and the carbon filter. The only utility required for this project is electrical power. The power requirement is less than 50 amps at 480 volts, which will come from existing motor control center.

Figure 4:
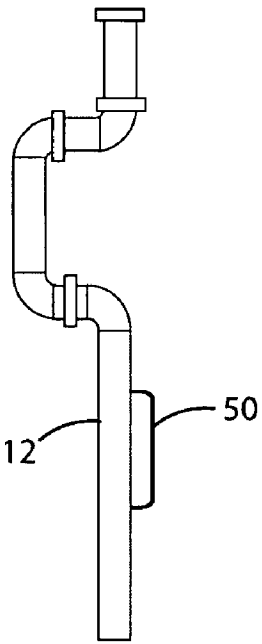
FIG. 4 is a side view of the scissor loading arm of this invention.

FIG. 4 is a side view of the loading arm of FIG. 1 shown in greater detail. FIG. 4 show loading arm 12 in a downward or filling position.

Couplings not shown connects arm 12 to a liquid source (not shown). Fitting attach to the upper end of arm 12 and are slidably mounted around the exterior. Handles 50 typically are one inch aluminum rods for moving arm 12 upwardly or downwardly. Movement may be manually or automated with electronic or mechanical means.

Figure 5:
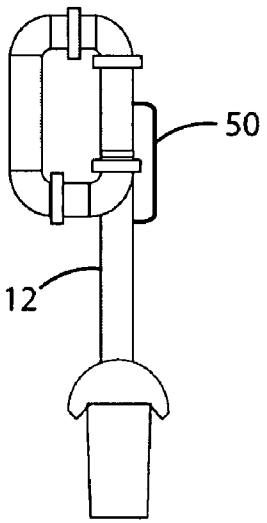
FIG. 5 is a side view of the scissor loading arm showing the arm in the retracted position.

FIG. 5 is a side view showing scissors loading arm 12 in a retracted (non-filling) position.

Figure 6:
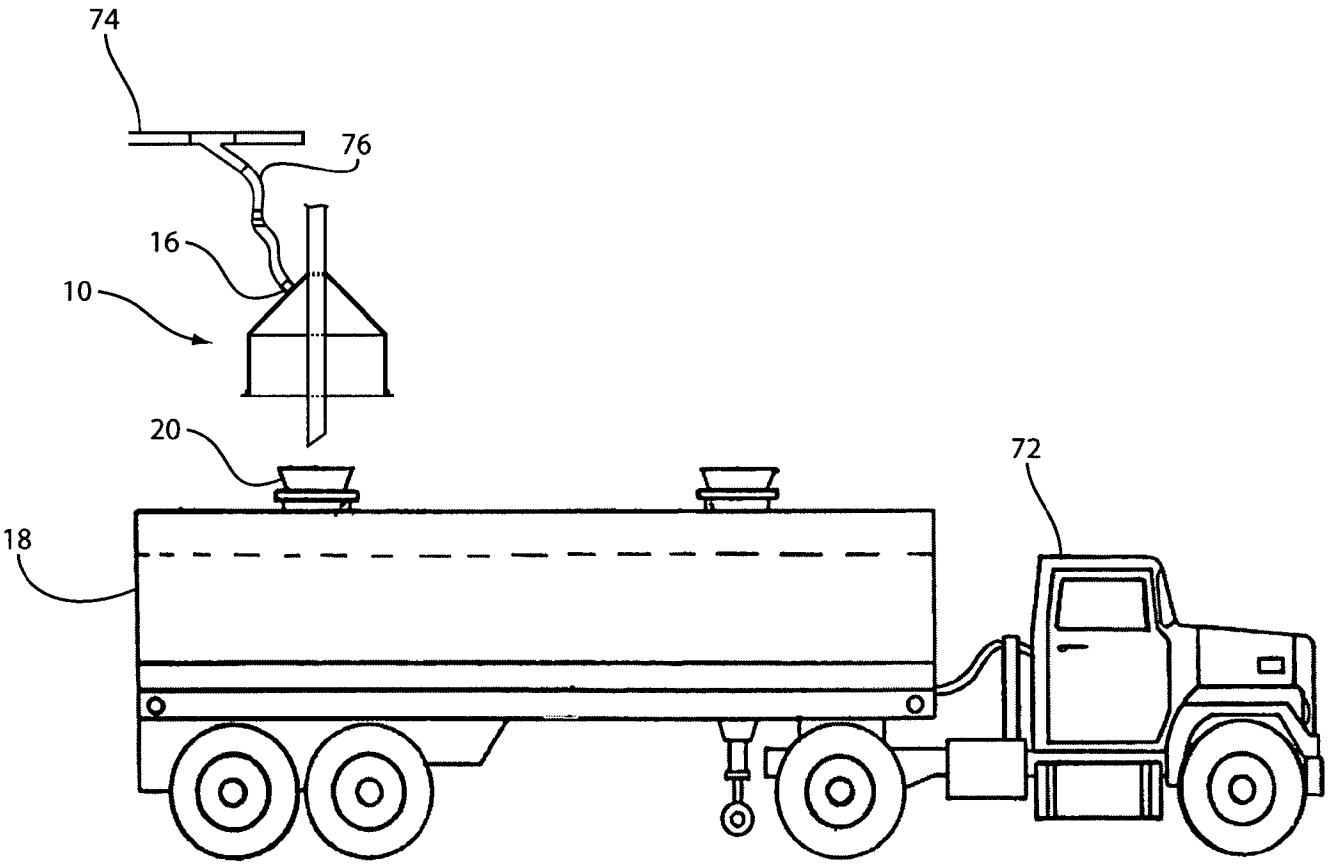
FIG. 6 is a side view showing the hood and loading arm of FIG. 1 in place over the dome opening on a receiving truck.

FIG. 6 is a side view showing the hood and drop tube assembly of FIG. 1 in place over the dome opening on a receiving truck. Assembly 10 is positioned over receiving tank 18 and opening 20. Typically receiving tank 18 rests on truck 72. Duct connector 16 connects to vapor recovery manifold 74 via vapor recovery hose 76.

EXAMPLE

The system provides positive suction around the dome opening on the truck. The vapors being released from the dome on the truck are being forced out of the truck as product is being loaded at a rate of 300-400 gallons per minute (GPM). The system is designed to provide 600 cubic feet per minute (CFM) of suction at each loading position. A typical terminal has 3 loading positions so the fan on the system is designed for 1800 CFM. The collection point at the truck uses a vapor hood that was custom designed and built for this application. The hood completely covers the opening of the dome without interacting with the dome-lid, truck, or other apparatuses at the loading location. The hood is attached to the loading arm so that whenever the arm is in the loading position the hood is in place and is able to capture the opacity. The hood has a 10" slip-on hose connection where a 10" corrosive resistant flexible hose connects to the hood. The flexible hose allows the arm to move between its stored position and the loading position while still connected the opacity system. The hose connects to the duct work above the loading lanes which moves the vapors to the filter unit. The duct work is appropriately sized to handle the various CFM and pressure drop throughout the system. Each loading lane has a damper which is adjusted to ensure that each lane has 600 CFM at the vapor hood. The duct is made of stainless steel to prevent corrosion and rust. The filter unit is hard piped to the duct work where the opacity is filtered out of the air. The cleaned air passes through the fan and is exhausted back into the atmosphere.

The system is a positive suction system where the vapors released from the tanker truck are captured provides a means to expand the application of the system to include, hazardous vapor removal, odor control, along with the opacity elimination.

By having the vapor hose attached to the hood on the load arm ensures that the hood/hose is in place to capture the vapors during every load. Removing the vapors form the loading rack and venting them at a remote location has improved the air quality at the loading rack.

The opacity system is tied into the PLC system to provide real-time status and diagnostic capabilities. The fan size and filter unit can be easily adapted for additional loading lanes.

In addition to these embodiments, persons skilled in the art can see that numerous modifications and changes may be made to the above invention without departing from the intended spirit and scope thereof.

We claim:

1. An apparatus for recovering vapors during the dispensing of liquid from a dispensing tank to a receiving tank comprising:

a rack opacity filtering system (ROFS);

a loading arm for dispensing liquid in to the receiving tank from the dispensing tank wherein the loading arm is a scissors loading arm;

a vapor recovery hood covering the receiving tank; and a vapor recovery duct attached to the hood for recovering vapors form the receiving tank; wherein the hood further comprises a second orifice and the vapor recovery duct is attached to the hood at the second orifice;

wherein the hood further comprises a first orifice wherein the loading arm passes through the orifice;

wherein the hood circumscribes the loading arm; and wherein the vapor recovery hood and vapor recovery duct attached to the hood further comprise a positive suction system to capture vapors released from the loading arm and receiving tank to provide vapor removal, odor control, and opacity elimination.

2. An apparatus according to claim 1 wherein the ROFS further Comprises a first stage of initial filtering.

3. An apparatus according to claim 2 wherein the first stage of initial filtering further comprises an opacity filter.

4. An apparatus according to claim 2 wherein the ROFS further comprises a second stage of filtering.

5. An apparatus according to claim 4 wherein the second stage of initial filtering further comprises an opacity filter.

6. An apparatus according to claim 1 wherein the vapor recovery duct covers the second orifice.

7. An apparatus according to claim 2 wherein the first initial stage of filtering is a coarse mesh filter.

8. An apparatus according to claim 4 wherein the second stage of filtering is a coalescing filter.

9. An apparatus according to claim 1 wherein ROFS further comprises at least one variable speed blower based on vacuum transmitter.

10. An apparatus according to claim 9 wherein the variable speed blower further comprises high speed and low speed actuation valves.

11. An apparatus according to claim 1 further comprising:

a vapor recovery conduit adaptable for recovering vapors from the dispensing tank;

wherein the vapor recovery conduits for recovering vapors from the dispensing tank and the receiving tank are connected to the ROFS.

* * * * *